US006755023B2

(12) United States Patent
Koenig et al.

(10) Patent No.: US 6,755,023 B2
(45) Date of Patent: Jun. 29, 2004

(54) METHOD AND DEVICE FOR EVACUATING A TURBINE CONDENSER

(75) Inventors: Thomas Koenig, Goerlitz (DE); Wolfgang Lehmann, Goerlitz (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/203,385

(22) PCT Filed: Dec. 20, 2000

(86) PCT No.: PCT/EP00/13039

§ 371 (c)(1),
(2), (4) Date: Aug. 9, 2002

(87) PCT Pub. No.: WO01/59265

PCT Pub. Date: Aug. 16, 2001

(65) Prior Publication Data

US 2003/0000215 A1 Jan. 2, 2003

(51) Int. Cl.[7] ..... F28B 7/00; F28B 9/10; F01K 9/02; F02B 1/00

(52) U.S. Cl. ..... 60/685; 60/686; 60/692; 60/693; 60/646; 60/656; 60/657

(58) Field of Search ..... 60/685, 686, 690, 60/692, 693, 646, 656, 657

(56) References Cited

U.S. PATENT DOCUMENTS

| | | | | |
|---|---|---|---|---|
| 2,927,428 A | | 3/1960 | Sala | 60/693 |
| 4,584,837 A | * | 4/1986 | Sakka et al. | 60/657 |
| 4,748,815 A | * | 6/1988 | Junior et al. | 60/692 |

FOREIGN PATENT DOCUMENTS

| | | | |
|---|---|---|---|
| DE | 1109722 | 6/1961 | |
| GB | 2147050 | 9/1984 | 417/60 |

* cited by examiner

*Primary Examiner*—Sheldon J. Richter
(74) *Attorney, Agent, or Firm*—Harness, Dickey & Pierce, P.L.C.

(57) ABSTRACT

In order to evacuate a turbine condenser, air contained in the turbine condenser is suctioned using propellant steam from a starting jet pump. The propellant steam and the air are guided into an auxiliary condenser which is arranged downstream from turbine condenser.

5 Claims, 1 Drawing Sheet

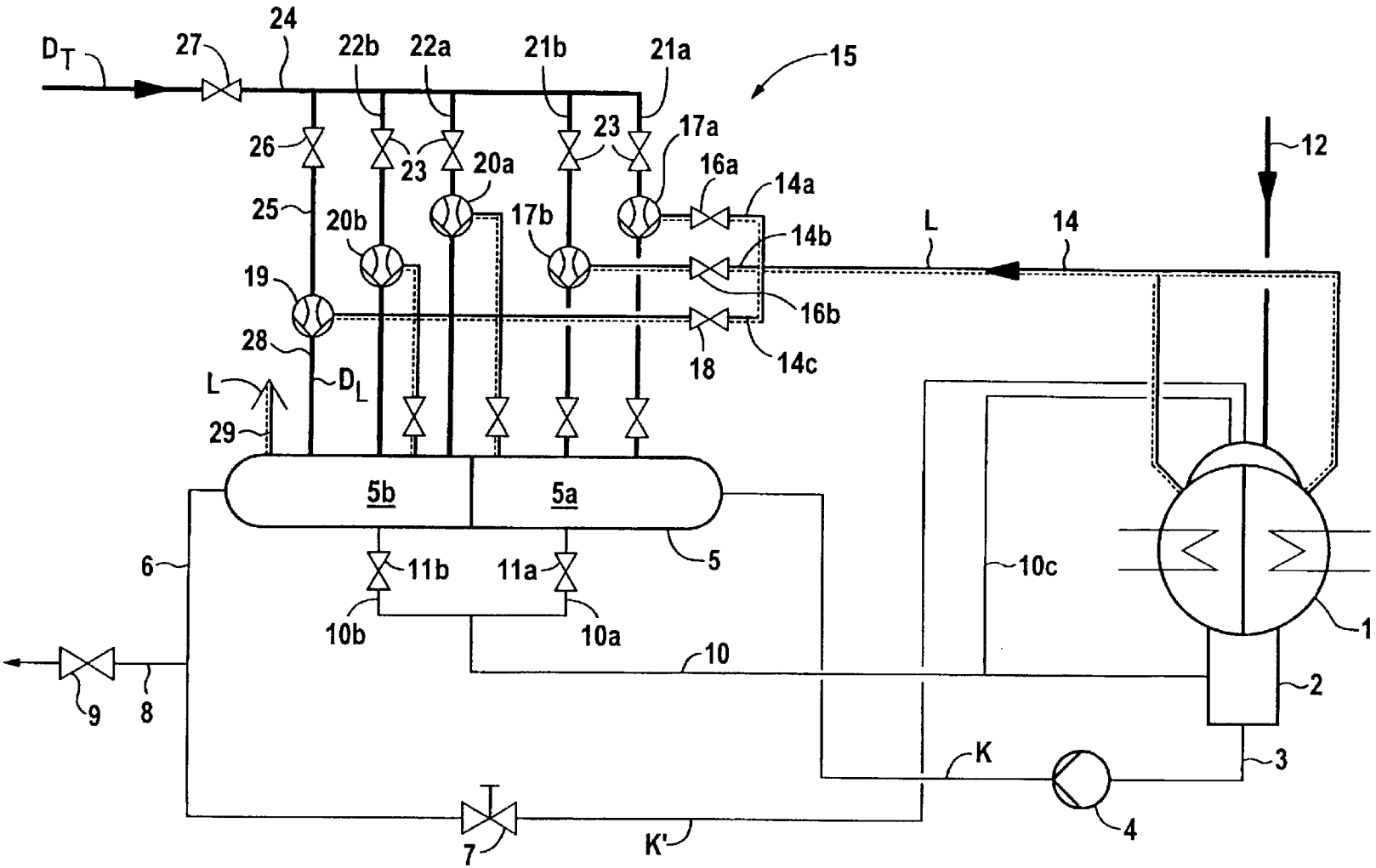
1
2
3
4
5
5a
5b
6
7
8
9
10
10a
10b
10c
11a
11b
12
14
14a
14b
14c
15
16a
16b
17a
17b
18
19
20a
20b
21a
21b
22a
22b
23
24
25
26
27
28
29
K
K'
L
$D_T$
$D_L$

METHOD AND DEVICE FOR EVACUATING A TURBINE CONDENSER

This application is the national phase under 35 U.S.C. § 371 of PCT International Application No. PCT/EP00/13039 which has an International filing date of Dec. 20, 2000, which designed the United States of America and which claimed priority on European patent application no. 00102718.4 filed Feb. 9, 2000, the entire contents of which are hereby incorporated by reference.

FIELD OF THE INVENTION

The invention generally relates to a method for evacuating a turbine condenser, particularly during a starting operation. The invention also generally relates to a device for carrying out the method.

BACKGROUND OF THE INVENTION

During the operation of a steam turbine installation, the steam, which is generally produced in a steam generator and expanded in a steam turbine to produce work, is condensed in a condenser connected downstream of the steam turbines. The condensate which appears in the turbine condenser is returned to the water/steam circuit of the steam turbine. In order to extract air contained in the turbine condenser or main condenser during the operation of the turbine installation, so-called operational jet pumps are frequently employed. These are joined to a propellant steam main and are connected to an auxiliary condenser connected downstream of the main condenser. Air mains connected to the main condenser are joined to the suction side of the operational jet pumps, which operate on the jet pump principle.

During the starting or restarting of the steam turbine, it is necessary to first evacuate the turbine condenser or main condenser. During this operation, the turbine condenser, and therefore the steam turbine installation, is evacuated from 1.0 bar down to approximately 0.3 bar within, for example, half an hour, by way of a so-called starting steam ejector, to which propellant steam is in turn admitted according to the jet pump principle. The steam/air mixture leaving the pressure side of the starting jet pump is conveyed to the open air via a pipeline. In this arrangement, the pipeline must be designed for the mixed temperature which occurs in the steam/air mixture and it is to be equipped with a noise suppressor because of environmental requirements which have to be met.

A disadvantage of this arrangement is that the propellant steam, which is usually extracted from the water/steam circuit of the steam turbines, is lost so that the feed water circuit of the turbine condenser has to be topped up by a corresponding quantity of feed water. This loss of feed water increases with increasing number of starting procedures and involves additional costs for the feed water treatment necessary.

SUMMARY OF THE INVENTION

An embodiment of the invention provides a method for evacuating a turbine condenser, in particular during the starting operation, by way of which the disadvantages mentioned are avoided in a particularly simple manner. In addition, a device which is for carrying out the method is provided.

With respect to the method, air contained in a turbine condenser may be extracted by way of propellant steam, conducted via a starting jet pump, and this air, together with the propellant steam. The extracted air is conducted into an auxiliary condenser connected downstream of the turbine condenser. Therefore, the propellant steam conducted via the starting jet pump is together with the air extracted from the turbine condenser introduced into the auxiliary condenser.

By this manner, the propellant steam condensing in the auxiliary condenser may be again supplied as condensate to the feed water circuit of the turbine condenser and, therefore, to the steam turbine installation. The air contained in the propellant steam is expediently removed from the auxiliary condenser.

In order to additionally permit a starting operation lasting several hours, at least half of the condensate quantity or feed water quantity corresponding to the nominal operation may be expediently made available for cooling in the auxiliary condenser. This only requires a corresponding design of a control valve which adjusts, in the usual manner, the condensate flow from the main condenser which is conducted via the auxiliary condenser.

In order, furthermore, to keep the heating of the condensate flow conducted via the auxiliary condenser within necessary limits, a major part, approximately 75% for example, of the condensate flow conducted by way of a condensate pump via the auxiliary condenser may be conducted via the condenser tubes of the main condenser. By this manner, the cooling water cooling of the main condenser is used to recool the partial condensate flow conducted via the auxiliary condenser. The relatively small proportion, approximately 25%, of the condensate flow, i.e. of the condensate quantity conveyed per unit time, is therefore available for the cooling, which is also necessary during the starting operation, of the quantities of water removed from the steam turbine.

With respect to the device, a starting jet pump is provided, which is connected to a propellant steam main and to an auxiliary condenser at the pressure end and is connected to the air main connected at the suction end to the main condenser.

The advantages achieved by way of the invention include, but are not limited to, the following. The propellant steam extracted from the water/steam circuit of a steam turbine, and employed for evacuating a turbine condenser, may be resupplied to the circuit by way of its introduction into the auxiliary condenser of a steam turbine installation. This avoids an undesirable topping up of feed water in the circuit. Furthermore, there is an additional saving with respect to a previously usual noise suppressor in the steam jet, air and pump system for removal of air from the turbine and condensate.

BRIEF DESCRIPTION OF THE DRAWINGS

An exemplary embodiment of the invention is explained in more detail below using the drawings. In this, the single FIGURE shows, diagrammatically, a turbine condenser with downstream auxiliary condenser and steam jet, air and pump system.

DETAILED DESCRIPTION OF THE PREFERRED EMBODIMENTS

A main condenser or turbine condenser 1 of a steam turbine installation (not shown) is connected at its outlet end by way of its condensate collector 2 to a condensate main 3, which is connected via a condensate pump 4 to the inlet end of an auxiliary condenser 5. At its outlet end, the auxiliary condenser 5 is connected via a condensate main 6 to the main condenser 1. In the condensate main 6, there is a circulation control valve 7 for adjusting the cooling condensate quantity necessary for a starting operation. A circulation main 8 which, for example, conducts condensate to steam generator heating surfaces and has a control valve 9, which is closed during the starting operation, is connected to the condensate main 6.

Condensate K which collects in the auxiliary condenser 5 is conducted via a condensate main 10 into the condensate collector 2 of the main condenser 1. For this purpose, the condensate main 10 is connected via two branch conduits 10*a* and 10*b* (in which there are respective shut-off valves 11*a*, 11*b*) to a first pressure stage 5*a* or to a second pressure stage 5*b* of the auxiliary condenser 5. A branch conduit 10*c* (which is used for the return of condensate) of the condensate main 10 leads into the main condenser 1, into which an exhaust steam main 12 from the steam turbine (not shown) opens.

Three partial mains 14*a*, 14*b* and 14*c* of a steam/air mixture pipeline 14, which is common to them, are connected to the main condenser 1. This pipeline 14 leads to a jet pump system 15 for evacuating or deaerating the main condenser 1 and, therefore, the turbine installation (not shown). For this purpose, the main 14 leads via a respective shut-off valve 16*a*, 16*b* to an operational jet pump 17*a* or 17*b* of the first pressure stage 5*a* of the auxiliary condenser 5. The main 14, which is connected to the main condenser 1, leads to a starting jet pump 19 via the partial main 14*c*, in which there is, in turn, a shut-off valve 18. This starting jet pump 19 is associated with the second pressure stage 5*b* of the auxiliary condenser 5.

The first and second pressure stages 5*a*, 5*b* of the auxiliary condenser 5 are respectively associated with a further operational jet pump 20*a* or 20*b*. The operational jet pumps 17*a*, 20*a* and 17*b*, 20*b* are embodied so as to provide redundancy.

The operational jet pumps 17*a*, 17*b* and 20*a*, 20*b* are respectively joined to a common propellant steam main 24 via branch mains 21*a*, 21*b* and 22*a*, 22*b*, in each of which there is a shut-off valve 23. The starting jet pump 19 is likewise joined to the propellant steam main 24 via a branch main 25, in which there is, in turn, a shut-off valve 26. A further shut-off valve 27 is located in the propellant steam main 24, propellant steam $D_T$ conducted via this shut-off valve 27 being extracted, in a manner not shown in any more detail, from a water/steam circuit of the steam turbine.

During a starting operation of the steam turbine installation, the turbine condenser 1 is first evacuated. For this purpose, propellant steam $D_T$ is conducted via the branch main 25 and via the starting jet pump 19 with the shut-off valves 27 and 26 open. The quantity of propellant steam $D_T$ conducted via the propellant steam main 24 and via the branch main 25 per unit time during the starting operation is determined by way of the starting jet pump 19. The propellant steam $D_T$ conducted via the starting jet pump 19, which operates on the jet pump principle, is (together with the air L which is extracted from the main condenser 1, via the air main 14, as a consequence of the depression which builds up within the main condenser 1) introduced as a steam/air mixture DL into the auxiliary condenser 5. For this purpose, the pressure end of the starting jet pump 19 is preferably connected via a connecting main 28 to the second pressure stage 5*b* of the auxiliary condenser 5. While the propellant steam $D_T$ is condensing in the auxiliary condenser 5, the air L entrained by the propellant steam $D_T$ is led away, out of the auxiliary condenser 5, via a deaeration main 29 to the atmosphere. The propellant steam $D_T$ which condenses in the auxiliary condenser 5 is introduced as condensate via the condensate main 10 into the condensate collector 2 of the main condenser 1 and, therefore, into its circuit.

In order to condense the propellant steam $D_T$ in the auxiliary condenser 5, a partial flow of condensate K from the main condenser 1 conveyed via the condensate pump 4 is supplied to the auxiliary condenser 5 as cooling water. The cooling water K', which is heated during the heat exchange with the propellant steam D within the auxiliary condenser 5, leaves the auxiliary condenser 5 via the condensate main 6. The setting valve or control valve 7 is used for adjusting the quantity of the condensate partial flow or cooling water K' conducted via the auxiliary condenser 5 per unit time. During the starting operation, the quantity of the cooling water K' is adjusted to approximately 50% to 70% of the nominal condensate quantity.

The operational jet pumps 17*a*, 17*b* and 20*a*, 20*b*, which are embodied so as to provide redundancy and of which, for example, the jet pumps 17*a* and 20*a* operate during the normal operation of the steam turbine installation whereas the two jet pumps are in standby operation, operate on the jet pump principle, like the starting jet pump 19. Whereas the starting jet pump 19 is used for evacuating the main condenser 1 during the starting of the steam turbine installation, the operational jet pumps 17*a*, 20*a* or 20*a*, 20*b* extract air L which appears in the main condenser 1 during the normal operation of the steam turbine installation.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A device for evacuating a turbine condenser, comprising:

a condenser;

an auxiliary condenser being connected to an outlet end of the condenser;

a starting jet pump being connected to a propellant steam main and to the auxiliary condenser at a pressure end thereof, the starting jet being further connected to an air main being connected at a suction end of a main condenser; and at least one operational jet pump being connected in parallel with the starting jet pump.

2. The device as claimed in claim 1, wherein the auxiliary condenser is connected, at an inlet end via a condensate pump and at an outlet end via a setting valve, to the main condenser.

3. The device as claimed in claim 1, comprising a plurality of operational jet pumps being embodied so as to provide redundancy.

4. The device as claimed in claim 3, wherein the auxiliary condenser is connected, at an inlet end via a condensate pump and at an outlet end via a settling valve, to the main condenser.

5. A device for evacuating a turbine condenser, comprising:

a condenser;

an auxiliary condenser being connected to an outlet end of the condenser;

a starting jet pump being connected to a propellant steam main and to the auxiliary condenser at a pressure end thereof, the starting jet being further connected to an air main being connected at a suction end of a main condenser; and wherein the auxiliary condenser is connected, at an inlet end via a condensate pump and at an outlet end via a setting valve, to the main condenser.

* * * * *